US008174370B1

(12) United States Patent
Fulmer-Mason

(10) Patent No.: US 8,174,370 B1
(45) Date of Patent: May 8, 2012

(54) AUTOMATED DOSAGE REMINDER CONSOLE

(75) Inventor: Julie Fulmer-Mason, San Francisco, CA (US)

(73) Assignee: MedFolio, Burlingame, CA (US)

( * ) Notice: Subject to any disclaimer, the term of this patent is extended or adjusted under 35 U.S.C. 154(b) by 66 days.

(21) Appl. No.: 12/320,217

(22) Filed: Jan. 22, 2009

(51) Int. Cl.
*G08B 1/00* (2006.01)

(52) U.S. Cl. ..... 340/309.16; 206/534

(58) Field of Classification Search ..... 340/309.16; 206/534, 538
See application file for complete search history.

(56) References Cited

U.S. PATENT DOCUMENTS

| | | | | |
|---|---|---|---|---|
| 4,663,621 | A * | 5/1987 | Field et al. | 340/5.3 |
| 5,720,154 | A * | 2/1998 | Lasher et al. | 53/411 |
| 2006/0215495 | A1* | 9/2006 | Soled et al. | 368/10 |
| 2008/0149659 | A1* | 6/2008 | Dishongh et al. | 221/3 |
| 2008/0277307 | A1* | 11/2008 | Mazur | 206/534 |

* cited by examiner

*Primary Examiner* — Shirley Lu

(57) ABSTRACT

An automated dosage reminder console uses a plurality of trays with dosage medication compartments, each dosage medication compartment including a basket having an integrally formed light pipe. Each compartment is selectively illuminated through the use of a program which controls corresponding light emitting diodes for alerting a user to consume a preselected dosage of medication on a preselected day at a preselected time. Sample pill identification boxes are aligned with corresponding dosage medication compartments to indicate the medication found in each basket.

18 Claims, 5 Drawing Sheets

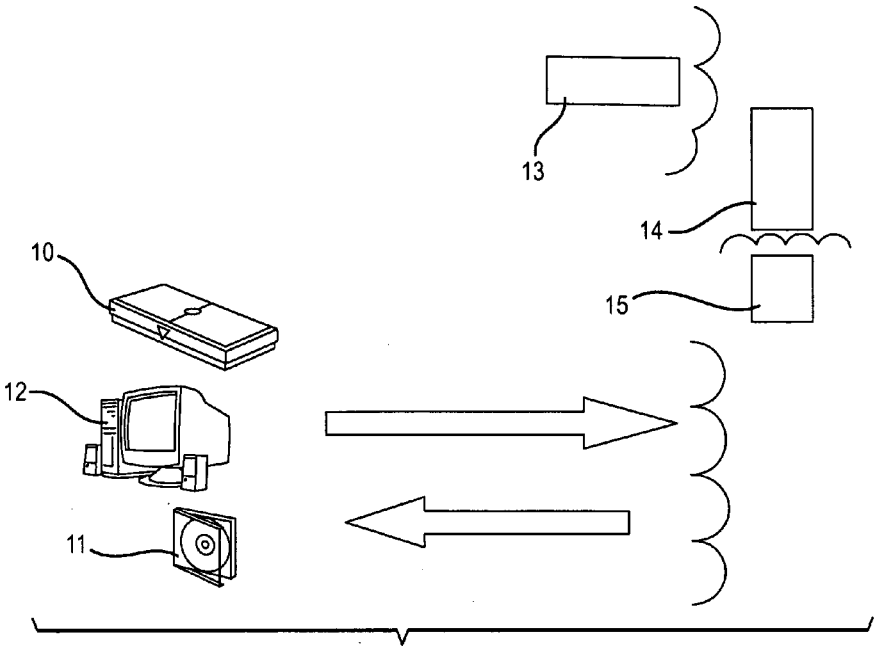
FIG. 1
FIG. 6
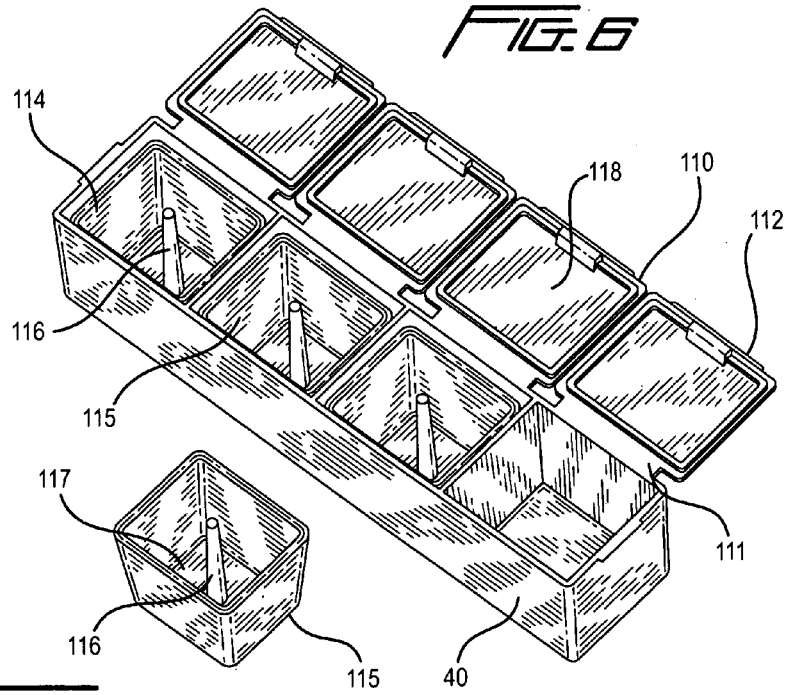
FIG. 6a

AUTOMATED DOSAGE REMINDER CONSOLE

FIELD OF THE INVENTION

The field of the invention relates to medication containers and, more specifically to automated drug dosage reminder containers.

BACKGROUND OF THE INVENTION

Some patients are required to take medicines, vitamins, and the like every day. In light of this factor such consumption becomes a very routine and repetitive, it is common to find that a person will not remember whether she has lately taken her scheduled medication. For instance, a person of sound mind but forgetful habits may find herself shortly after breakfast trying to recall whether she took at breakfast her collection of pills. A more important failing is that the person cannot remember how much of a particular consumable she is to take, especially when the information is not printed the label of the bottle holding it.

Moreover, in the medical treatment of one or more patients prescribed with a singular or a plurality of variously timed frequency of drug intake, there have been a multitude of mistakes committed by the patients, the medical personnel and home care specialists thus resulting in the undesired drug dosage as well as over-dosage that clinically affect millions of patients in an adverse manner. The problem behind these unwanted occurrences is largely because of patients and care takers not having drug dispensing system which displays the medication in an attention reaching format within an organized display.

Prior art drug reminder containers are well known and the patent art is crowded with patents describing systems for alerting patients to take their medication. Most prior art alert containers contain a supply of the same dosage which is taken several times a day at a predetermined time. These types of alert containers include a sounding device or may illuminate to warn a patient to take the prescribed dosage.

Some devices are known for specific use with pills. For example, a container may have a plurality of compartments, each identified according to the day and time period at which the pills are to be taken. Typically, the patient fills each compartment beforehand with the pills to be taken at each scheduled time. Thereafter she removes them from each labeled compartment when the predetermined time arrives and congests the dosage. While effective, this system requires the patient or care taker to handle the medication and sort each pill from their normal containers into the compartments. The transfer of pills can be tedious and chances of error increase with a more variety of pills.

Patients taking pills and medications on a time oriented schedule is a difficult task for many people, especially the elderly. While it is often difficult to remember the dosage and type of pills that need to be taken, it is also tough to remember if the necessary pills have already been taken. Depending on the medication being taken, it can be dangerous to a person's health or mental well being if a dosage is missed or accidentally exceeded because the person forgot that they already took the proper dosage.

More recent attempts to overcome the problems of prior art containers are the use of an automated container which improves patient compliance in taking the appropriate medication on schedule. Dosing regimens that require the patient to take different doses of different medications at different times can be particularly confusing. For example, a prescription that requires a patient to take three doses of a first medication and one dose of a second medication can be confusing. A patient can inadvertently take one dose of the first medication and three doses of the second medication. In addition, some medications are taken in a paired dosing regimen, with the first medication taken on Monday, and the second medication being taken on Tuesday, the first medication on Wednesday, etc. Some medications are not intended to be taken together at all because they either neutralize each other or cause adverse side effects that can result in illness or even death. This situation is particularly troublesome when more than one physician is prescribing medication to the patient. Most medication containers designed for a patient's personal use on an out-patient basis do not assist the patient in taking the correct medication at the correct time, particularly when several medications have been prescribed.

The patent to Edelstein U.S. Pat. No. 4,890,741 discloses a capsule package including a medication storage compartment with a child-resistant cap assembly, and a smaller compartment for receiving the cap assembly of another receptacle. Instructions for taking the medication may be stored in the smaller compartment. However, Edelstein is intended for holding a bulk quantity of each medication in each container, it is not suitable for pre-organizing the dosages to be taken at future times.

The patent to Price U.S. Pat. No. 5,720,392 discloses a prescription timer for indicating when a person took a pill or when he/she is next scheduled to take a dose of medication. The timer may be attached to a pill bottle having a cap. However, Price only provides a single compartment, making it unsuitable for use with multiple medications.

U.S. Pat. No. 5,899,335 discloses a medication container, including a method for using the container. The container takes the form of a clock face, with compartments corresponding to the hours of the day. Boyer is best suited for a person who must take medication at virtually every hour of the day. However, Boyer does not allow a user to pre-arrange medication for a period longer than a single day.

Other types of medication containers that remind a patient to take their medication or keep track of the number of doses of medication in the container are well known. Examples of such automated containers are disclosed in U.S. Pat. No. 3,227,127 (Gayle); U.S. Pat. No. 4,207,992 (Brown); U.S. Pat. No. 4,360,125 (Martindale); U.S. Pat. No. 4,483,626 (Noble); U.S. Pat. No. 4,504,153 (Schollmeyer); U.S. Pat. No. 4,526,474 (Simon); U.S. Pat. No. 4,573,606 (Lewis); U.S. Pat. No. 4,695,954 (Rose); U.S. Pat. No. 4,725,997 (Urguhart); U.S. Pat. No. 4,939,705 (Hamilton); U.S. Pat. No. 4,984,709 (Weinstein); U.S. Pat. No. 5,099,463 (Lloyd); U.S. Pat. No. 5,181,189 (Hafler); U.S. Pat. No. 5,213,332 (Kraft); U.S. Pat. No. 5,313,439 (Albeck); U.S. Pat. No. 5,392,952 (Bowden); and U.S. Pat. No. 5,472,113 (Shaw) and, the disclosures of which are incorporated by reference.

The present invention overcomes these and other limitations in existing medication dispensing products. Thus, there exists a need for an automated system for providing a patient with a visual and alarm alert case which holds a multiplicity of pills for dosages at predetermined times of the day for each month.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

SUMMARY OF THE INVENTION

The invention relates to an automated dosage reminder console used to remind or alert a user to consume a preselected dosage of medication on a preselected day at a preselected time.

One object of the present invention is to provide an automated dosage reminder console which controls the timing of a plurality leds which have been programmed to illuminate a particular a dosage medication compartments to remind a user to take medication provided in the illuminated compartment.

Another object of the instant invention is to provide an automated dosage reminder console having 28 individual medication dosage compartments and labeled for 7 days of the week Monday, Tuesday, Wednesday, Thursday, Friday, Saturday, Sunday with each day having a time of the day label such as "Morning", "noon", "eve", Still another object of the present invention is to provide automated dosage reminder console having a plurality of trays with dosage medication compartments, each dosage medication compartment including a basket having an integrally formed light pipe which are selectively illuminated by corresponding light emitting diodes for alerting a user to consume a preselected dosage of medication on a preselected day at a preselected time.

And yet a further object of the present invention is to provide an automated dosage reminder console comprising a pair of columns, each column having sample pill identification boxes, each box containing a sample pill.

A still further object of the present invention is to provide an automated dosage reminder console which includes a cover having a display surface for the placement of labels used to describe medication located in a corresponding sample pill identification box.

And yet another object of the present invention is to provide an automated dosage reminder console having a sample pill identification boxes which align with corresponding dosage medication compartments to indicate the medication found in each particular compartment.

And still a further object of the present invention is to provide an automated dosage reminder console having a power indicator led.

And yet a further object of the present invention is to provide an automated dosage reminder console having a USB port.

It is an object of the invention to provide an automated dosage reminder console provided with a custom patients program which reminds a patient at preselected times and days to take their medication. Programmed timed dosage medication compartments are selectively illuminated by a plurality of leds. An automated dosage reminder console uses a plurality of trays with dosage medication compartments, each dosage medication compartment including a basket having an integrally formed light pipe. Each compartment is selectively illuminated through the use of a program which controls corresponding light emitting diodes for alerting a user to consume a preselected dosage of medication on a preselected day at a preselected time. Sample pill identification boxes align with corresponding dosage medication compartments to indicate the medication found in each basket.

The invention may be embodied in the form illustrated in the accompanying drawings. Attention is called to the fact that the drawings are illustrative only. Variations are contemplated as being part of the invention, limited only by the scope of the claims.

DETAILED DESCRIPTION OF THE DRAWINGS

FIG. 1 is a schematic view of a process of creating and sending a custom patient program to an automated dosage reminder console of the present invention

Figure 5:
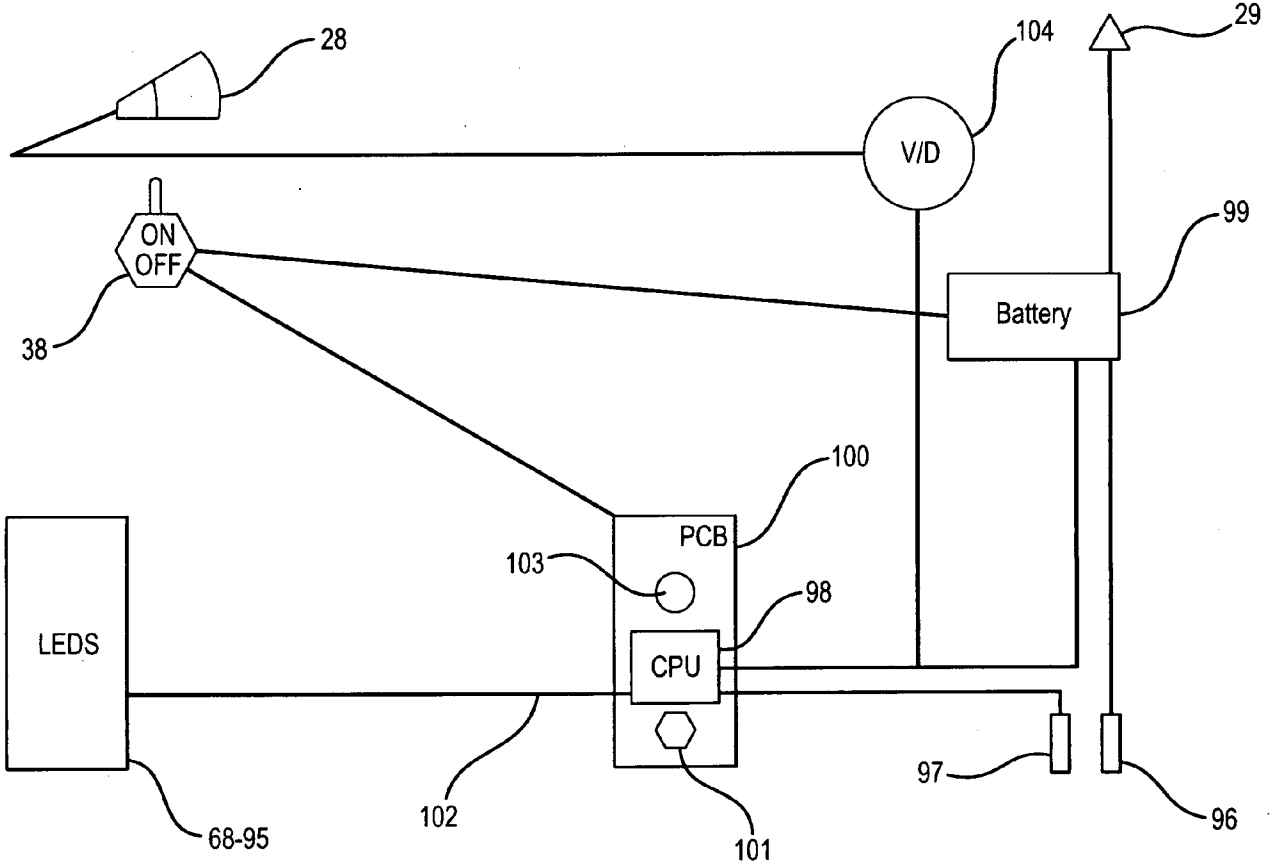

FIG. 5*a* is a top elevated view of automated dosage console with trays and cover removed.

FIG. 5*a* is a rear elevated view of automated dosage console with trays and cover removed.

FIG. 6 is a perspective view of a tray for the automated dosage console.

FIG. 6*a* is a perspective view of a basket for the automated dosage console.

DETAILED DESCRIPTION OF THE INVENTION

The present invention is directed to an automated dosage reminder console 10 which alerts a patient that it is time to take medication.

As shown in FIG. 1, an automated dosage reminder console 10 is used in conjunction with software 11 and a personal desk top computer 12 to load a custom patient program into the automated dosage reminder console 10 in order to provide the automated dosage reminder console 10 with a regimented customized program that alerts a patient each time a particular medication is to be taken. Illustrated in FIG. 1 is a physician's office or hospital 13 where a doctor may write a prescription along with times and days of the month that each patent must take the medication and email the prescription data to a pharmacist's office 14. The patient may also pick up the prescription. The dosage and times for taking the prescription are then sent to a central server 15 where the data is stored in a record medium in each patent's file. Based on the information a dosage file is recorded in a custom patient program so the program may be sent to the patient's computer 12. The dosage file provides a custom patient program which includes a process for assisting the user to comply with a medication time table. The program may be downloaded to the patient's computer 12 and transferred to the automated dosage console 10.

Software provided to the automated dosage reminder console 10 is designed to operate the electronic components of the automated dosage console 10 for alerting a user to consume a preselected dosage of medication on a preselected day at a preselected time. The program controls the timing of a light and voice system to remind the user about the medication.

The automated dosage console 10 is illustrated in FIGS. 2-6*a*. The automated dosage console 10 includes a console 10*a*, a housing 20 with a cover 21, a base 22, a front panel 23, a rear side 24, a left side 25 and a right side 26. The cover includes a handle 27 and may be made of translucent opaque plastic material so the contents inside the automated dosage console 10 may be illuminated and displayed by the light. A speaker 28 is positioned on the front panel 23 along with a triangular light emitting diode 29. The triangular led 29 serves as an indicator light which provides a visual indication of dosage time. The triangular led will also illuminate when the battery is low on power. On the rear side 24 of the console 10*a* is a USB port and a power port not shown in the drawing.

Figure 3:
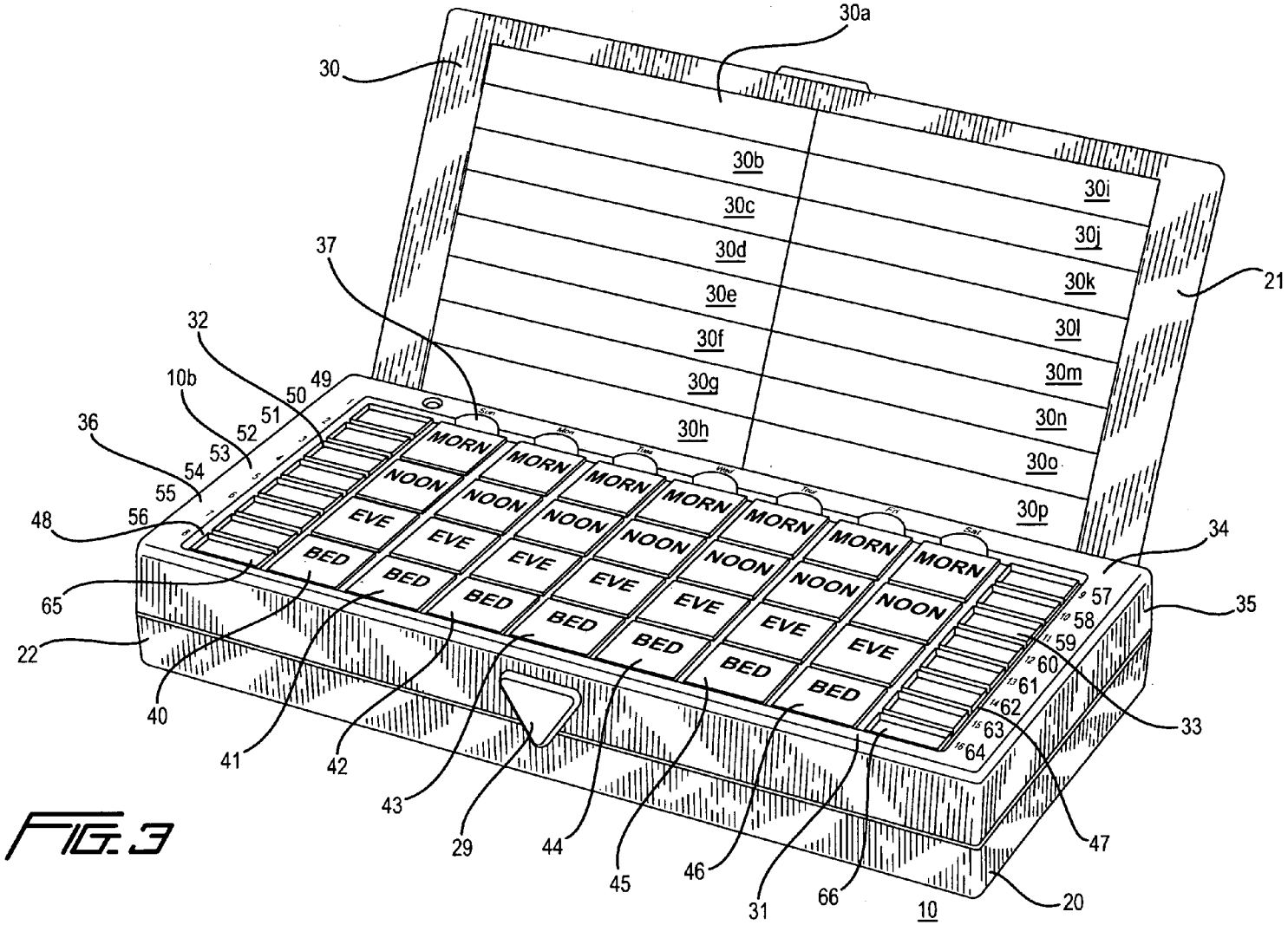
FIG. 3 is an open perspective view of the automated dosage console.

FIG. 3 illustrates the automated dosage console 10 with the cover 21 open to display the contents of the automated dosage console 10. The cover 21 has a display surface 30 for the placement of labels 30*a*-30*p* used to describe particular dosages along with numbers 1-8 and 9-16 adjacent each dosage description. The information printed on the labels 30*a*-30*p* supplied from the custom patient program.

A frame 31 surrounds the interior perimeter of the automated dosage console 10 and defines a basin 32. Top portion 33 frame 31 is provided with indicia 34 which indicates the days of the week MON, TUES, WED, THURS, FRI, SAT, SUN in letter form and in Braille. Left side 35 of the frame includes numbers 1-8 and right side 36 of the frame 30 are numbers 9-16. The frame 30 also includes thumbs holds 37 which permit a user to easily remove the contents of the console 10*a*. An on-off switch 38 is also provided to manually operate the console 10*a*.

Positioned inside the basin 32 are seven trays 40-46 and two columns 47, 48 which provide sample pill identification boxes 49-64. Each sample pill identification box 49-64 holds a sample pill 65 which is described on each corresponding label 30*a*-30*p* in accordance with numbers 1-16 as provided on the frame 31 and on the display surface 30 of the cover 21. Inside each sample pill identification box 49-64 is pill holding material 66 which may be foam or cotton.

Figure 2:
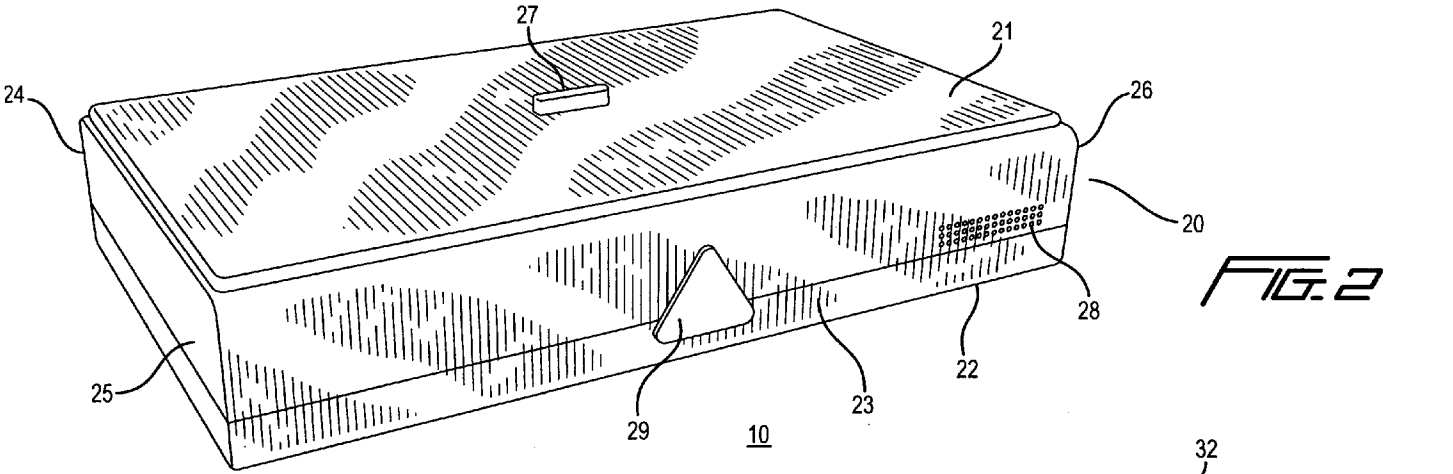
FIG. 2 is a perspective view of the automated dosage reminder console of the present invention.
Figure 4A:
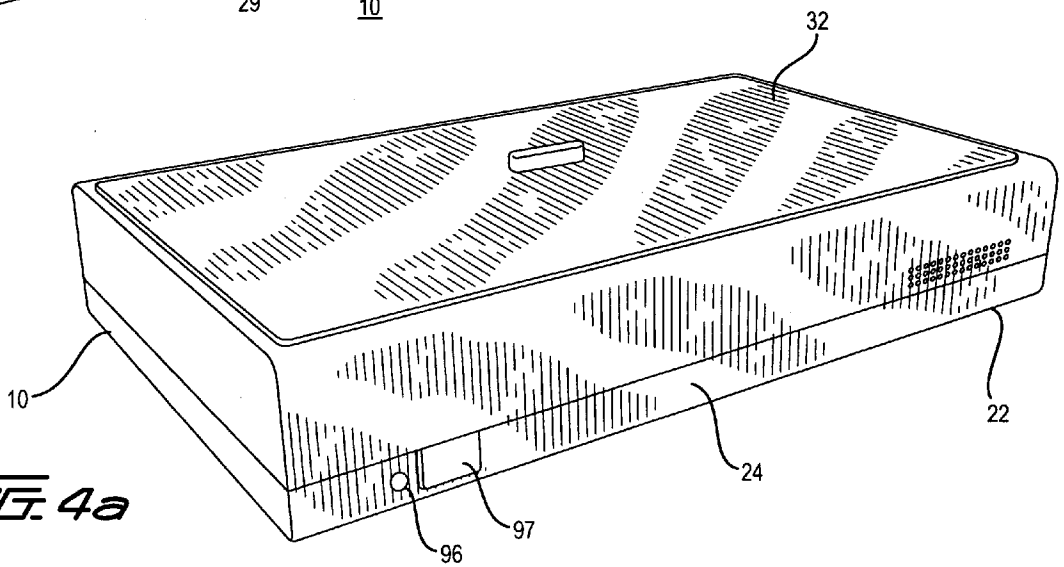
FIG. 4 is schematic view of an electronics system used for the automated dosage console.
Figure 4:
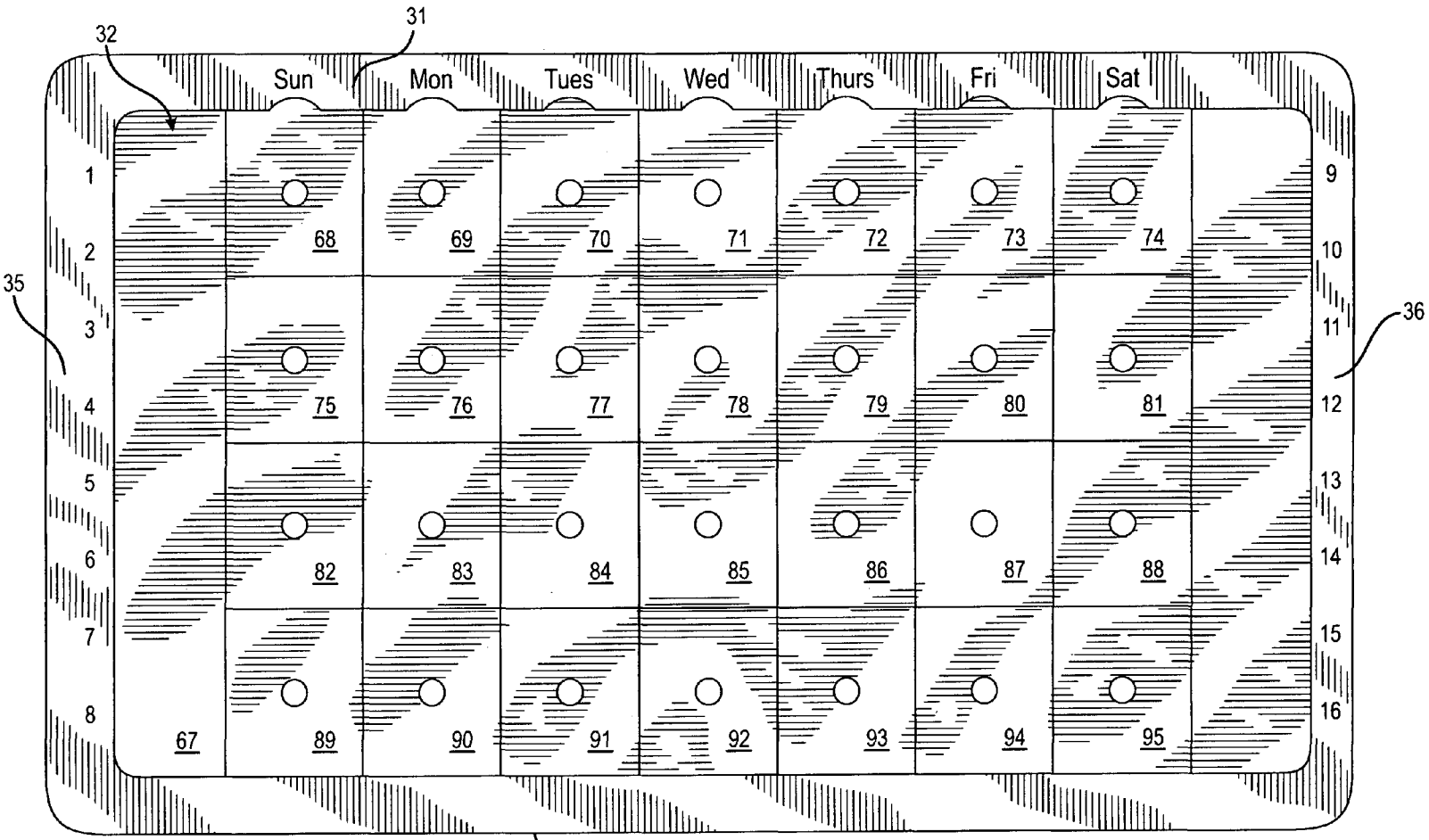

FIG. 4 is an elevational view of the console 10*a* with the trays 40-46 and the sample boxes 49-64 removed from the interior. Mounted flush with floor 67 of the basin are light emitting diodes 68-93. Each diode is mounted for positioning under the trays in order to project light into the tray. FIG. 4*b* is a rear elevational view of the console 10*a* with the trays 40-46 and the sample boxes 49-64 removed from the interior. On the rear panel is a power port 96 and a USB port 97. The USB port 97 provides a means for connecting the console to the interne or any computer or any telecommunications device such as a PDA for the transfer of a program to the console 10*a*. The USB port further provides communication for downloading the dosing information including email or text messaging. While only one USB port is shown more than one USB ports may be provided in another embodiment of the console. The power port 96 permits connection to an AC/DC converter.

The base 22 of the console 10*a* houses the electronics hardware used to power the console 10*a* which is operated by a personalized patient prescription program. As illustrated in schematic form in FIG. 5, the electronics hardware includes a CPU 98, battery 99, a printed circuit board 100, a programmable memory 101, a circuit 102, a speech chip 103 and a voice driver 104. The CPU 95 is used to operate LEDS 68-93, triangular LED 29 and speaker 28 through the circuit 102. The circuit 102 connects the speaker 28, the on-off switch 38 and the remaining electronic components to the battery 96. The on-off switch allows the user to turn off the leds and audio after an alert has been placed. Turning off the on-off switch at all other times has no effect on the console 10*a*.

Turning now to FIGS. 3, 6 and 6*a* trays 40-46 are used to store the medication. Each tray 40-46 includes a lid 110 integrally formed with the tray 40-46 through a living hinge 111. Each lid 110 is also provided with a handle. 112 to assist the patient in opening a tray. Indicia 113 is formed on the lid 110 to indicate Morn, Noon Eve or Bed. The trays 40-46 provide 28 dosage medication compartments 114 as seen in FIG. 3. The sample pill identification boxes 49-64 align with corresponding dosage medication compartments 114 to indicate the medication found in medication compartment 114.

Located in each dosage medication compartment 114 is a basket 115. Each basket 115 holds medication in pill form and is made of light transmitting material. Integrally formed with the basket 115 is a light pipe 116 which also serves as a basket handle for removing the basket from the tray. The light pipe 116 extends from a central floor surface 117 of the basket to a top central area 118 just under the lid 110. The position of each basket 115 inside each dosage medication compartment 114 aligns each light pipe 115 over each corresponding led mounted in the basin 32 under the trays 40-46. When a led is illuminated, the light is projected through the light pipe 116 to illuminate a preselected dosage medication compartment 114 to alert a user to consume the preselected dosage of medication found in the basket 115 of the illuminated dosage medication compartment 114. In addition, the sample pill identification boxes 49-64 align with corresponding dosage medication compartments 114 to indicate the medication found in each particular compartment.

In operation, the custom patient program controls the timing of the leds 63-93 and triangular led 29 under the dosage medication compartments 114. Each led 29, 68-93 illuminates, as programmed, at the time a particular compartment is to be opened and the dosage consumed by the patient. In addition, the console also provides an audio alarm of three constant beeps when the dosage leds are illuminated. The leds may be lit for 30 minutes prior to the time to take the medication. There are 28 individual medication dosage compartments and labeled for 7 days of the week Monday, Tuesday, Wednesday, Thursday, Friday, Saturday, Sunday with each day having a time of the day label such as "Morning", "noon", "eve", "bed". Each compartment is selectively illuminated through the use of custom patient medication program which controls all the corresponding light emitting diodes for alerting a user to consume a preselected dosage of medication on a preselected day at a preselected time.

In conclusion, herein is presented an automated dosage reminder console. The invention is illustrated by example in the drawing figures, and throughout the written description. It should be understood that numerous variations are possible, while adhering to the inventive concept. Such variations are contemplated as being a part of the present invention.

The invention claimed is:

1. An automated dosage reminder console for alerting a user to consume a preselected dosage of medication on a preselected day at a preselected time, said automated dosage reminder console comprising:

a base, said base containing a battery, a programmable memory, a printed circuit board and a circuit, a basin, said basin having a plurality of LEDs connected to said circuit, a plurality of trays, each tray having a plurality of dosage medication compartments, each dosage medication compartment including a basket, each basket having an integrally formed light pipe, each tray positioned in said basin to align each of said plurality of LEDs with each of said light pipes for projecting light through a preselected dosage medication compartment for alerting a user to consume a preselected dosage of medication on a preselected day at a preselected time, and each light pipe extending from a central floor surface of said basket to a top central area of said basket.

2. The automated dosage reminder console as recited in claim 1, said automated dosage reminder console further comprising sample pill identification boxes, each box containing a sample pill.

3. The automated dosage reminder console as recited in claim 1, said automated dosage reminder console further comprising a pair of columns, each column having sample pill identification boxes, each box containing a sample pill.

4. The automated dosage reminder console as recited in claim 1, said automated dosage reminder console further comprising a cover, said cover having a display surface for the placement of labels, each label used to describe medication located in a corresponding sample pill identification box.

5. The automated dosage reminder console as recited in claim 1, said automated dosage reminder console further comprising a triangular LED, said triangular LED providing an illuminating visual indication to said user to open said cover and take medication provided in an illuminated dosage medication compartment.

6. The automated dosage reminder console as recited in claim 1, said automated dosage reminder console further comprising a triangular LED, said triangular LED providing an illuminating visual indication to said user that said console is weak on power.

7. An automated dosage reminder console for alerting a user to consume a preselected dosage of medication on a preselected day at a preselected time, said automated dosage reminder console comprising:

a base, said base containing a battery, a programmable memory, a printed circuit board and a circuit;

a basin, said basin having a plurality of LEDs connected to said circuit;

a plurality of trays, each tray having a plurality of lids and a plurality of dosage medication compartments, each dosage medication compartment including a basket, each basket having an integrally formed light pipe, each tray positioned in said basin to align each of said plurality of LEDs with each of said light pipes for projecting light through a preselected dosage medication compartment for alerting a user to consume a preselected dosage of medication on a preselected day at a preselected time, and each light pipe extending from a central floor surface of said basket to a top central area of said basket.

8. The automated dosage reminder console as recited in claim 7, said automated dosage reminder console further comprising sample pill identification boxes, each box containing a sample pill.

9. The automated dosage reminder console as recited in claim 7, said automated dosage reminder console further comprising a pair of columns, each column having sample pill identification boxes, each box containing a sample pill.

10. The automated dosage reminder console as recited in claim 7, said automated dosage reminder console further comprising a cover, said cover having a display surface for the placement of labels, each label used to describe medication located in a corresponding sample pill identification box.

11. The automated dosage reminder console as recited in claim 7, said automated dosage reminder console further comprising a triangular LED, said triangular LED providing an illumination visual indication to said user to open said cover and take medication provided in an illuminated dosage medication compartment.

12. The automated dosage reminder console as recited in claim 7, said automated dosage reminder console further comprising a triangular LED, said triangular LED providing an illuminating visual indication to said user that said console is weak on power.

13. An automated dosage reminder console for alerting a user to consume a preselected dosage of medication on a preselected day at a preselected time, said automated dosage reminder console comprising:

a base, said base containing a battery, a programmable memory, a printed circuit board and a circuit, a basin, said basin having a plurality of LEDs connected to said circuit for operating said plurality of LEDs according to a program stored in said programmable memory, a plurality of trays, each tray having a plurality of dosage medication compartments, each dosage medication compartment including a basket, each basket having an integrally formed light pipe, each tray positioned in said basin to align each of said plurality of LEDs with each of said light pipes for projecting light through a preselected dosage medication compartment for alerting a user to consume a preselected dosage of medication on a preselected day at a preselected time; and each light pipe extending from a central floor surface of said basket to a top central area of said basket.

14. The automated dosage reminder console as recited in claim 13, said automated dosage reminder console further comprising sample pill identification boxes, each box containing a sample pill.

15. The automated dosage reminder console as recited in claim 13, said automated dosage reminder console further comprising a pair of columns, each column having sample pill identification boxes, each box containing a sample pill.

16. The automated dosage reminder console as recited in claim 13, said automated dosage reminder console further comprising a cover, said cover having a display surface for the placement of labels, each label used to describe medication located in a corresponding sample pill identification box.

17. The automated dosage reminder console as recited in claim 13, said automated dosage reminder console further comprising a triangular LED, said triangular LED providing an illuminating visual indication to said user to open said cover and take medication provided in an illuminate dosage medication compartment.

18. The automated dosage reminder console as recited in claim 13, said automated dosage reminder console further comprising a triangular LED, said triangular LED providing an illuminating visual indication to said user that said console is weak on power.

* * * * *